United States Patent [19]

Hacknauer et al.

[11] Patent Number: 4,997,016

[45] Date of Patent: Mar. 5, 1991

[54] RECEIVING APPARATUS FOR A TONER CONTAINER AND TONER CONTAINER THEREFOR

[75] Inventors: Frank Hacknauer, Honeoye Falls; Kenneth D. Corby, Rochester, both of N.Y.

[73] Assignee: Eastman Kodak Company, Rochester, N.Y.

[21] Appl. No.: 360,808

[22] Filed: Jun. 2, 1989

[51] Int. Cl.[5] ..... G03G 15/08

[52] U.S. Cl. ..... 141/363; 141/346; 141/353; 141/386; 222/DIG. 1; 355/260

[58] Field of Search ..... 355/260, 245, 326; 141/1, 89, 312, 319-332, 346, 372, 351-354, 360, 375, 362-366, 369, 370, 383, 386; 222/325, 541, 561, DIG. 1; 206/527, 631; 220/331, 346

[56] References Cited

U.S. PATENT DOCUMENTS

| | | | |
|---|---|---|---|
| 904,745 | 11/1908 | Adams | 222/561 |
| 4,062,385 | 12/1977 | Katusha et al. | 141/89 |
| 4,065,335 | 12/1977 | Pollack | 53/41.2 |
| 4,237,943 | 12/1980 | Ermel et al. | 141/284 |
| 4,491,161 | 1/1985 | Tamura et al. | 141/364 |
| 4,538,651 | 9/1985 | Lykins | 141/1 |
| 4,599,851 | 7/1986 | Williams | 53/471 |
| 4,614,286 | 9/1986 | Yamaguchi | 222/505 |
| 4,650,070 | 3/1987 | Oka | 206/216 |
| 4,778,086 | 10/1988 | Shibata et al. | 222/325 |
| 4,834,246 | 5/1989 | Inoue et al. | 206/631 |

FOREIGN PATENT DOCUMENTS

| | | | |
|---|---|---|---|
| 59-126563 | 7/1984 | Japan | 355/260 |
| 59-204063 | 11/1984 | Japan | 355/260 |
| 60-258571 | 12/1985 | Japan | 355/260 |
| 63-109465 | 5/1988 | Japan | 355/326 |
| 63-137259 | 6/1988 | Japan | 355/260 |
| 63-178274 | 7/1988 | Japan | 355/260 |

*Primary Examiner*—Henry J. Recla
*Assistant Examiner*—Casey Jacyna
*Attorney, Agent, or Firm*—Leonard W. Treash, Jr.

[57] ABSTRACT

A receiving apparatus for a toner container has a toner cavity over which the containing portion of the container is slid. To prevent skiving of toner into the workings of the machine, a guide forces at least the leading part of the containing portion through a higher path with respect to the cavity as it moves over the cavity than the path it takes moving back to a position beside the cavity. A toner container for such a receiving apparatus includes a flange with extensions of the flange away from the container for cooperating with the guide of the apparatus.

9 Claims, 4 Drawing Sheets

RECEIVING APPARATUS FOR A TONER CONTAINER AND TONER CONTAINER THEREFOR

TECHNICAL FIELD

This invention relates to a receiving apparatus for toner containers for use in copiers, printers and the like. It also relates to a toner container for such a receiving apparatus.

BACKGROUND ART

U.S. Pat. No. 4,062,385, issued Dec. 13, 1977 to Katusha et al, shows a toner container having a containing portion with an opening on the bottom and a flange extending outward from the opening. A cover is slidably secured to the flange. A receiving apparatus for the container includes a sump cavity for receiving toner through the bottom of the container when the opening of the container is positioned directly above it. The container and cover are positioned beside the cavity and the container portion is slid off the cover and over the cavity with the flange sliding on a receiving surface that surrounds the cavity.

A problem with this system is that the leading edge of the flange as the container is slid to its position over the cavity has a tendency to skive toner associated with the cavity out of the cavity area and into the workings of the apparatus and into the air. Airborne toner or toner in the apparatus causes a myriad of problems with the apparatus and anyone working with the apparatus.

DISCLOSURE OF THE INVENTION

It is an object of the invention to provide a receiving apparatus for a toner container generally of the type described in which this tendency of the toner to skive into the workings of the apparatus is greatly lessened or eliminated.

It is also an object of the invention to provide a toner container which cooperates which such receiving apparatus to accomplish such objective.

These and other objects are accomplished by a receiving apparatus generally of the type described but which has means for guiding the flange of a received container as it moves from a position beside the cavity to position over the cavity along a path in which at least the leading portion of the flange is separated from the receiving surface adjoining the cavity. This same guide means permits the flange to move on the surface adjoining the cavity as it returns to its position beside the cavity.

According to a preferred embodiment of the invention, the means for guiding the flange includes at least one elongated insert positioned along a side of the cavity. One end of the insert has a first cam surface forcing the flange to move along the top of the insert as the containing portion moves to its position over the toner cavity. The other end of the insert has a second cam surface forcing the flange to move below the insert as it moves back to its position beside the cavity.

With such structure the return movement of the flange skives toner back into the sump or into the container, on top of the cover. When the next container is placed on the receiving apparatus and is moved to its position with its opening over the cavity, the leading part of the flange traverses a higher path separated from the return, skiving path of the previously removed container and therefore does not skive toner into the apparatus.

These and other objects are also accomplished by a container for supplying toner to a toner receiving apparatus as described above. The container includes a containing portion having an opening in its bottom. A flange is disposed on opposite sides of the opening. Means associated with the flange cooperate with the guide means of the receiving apparatus to guide the flange as it moves along a path separated from the receiving surface of the apparatus as the container moves to a position with its opening over the cavity.

According to a preferred embodiment of the container, the means cooperating with the guide means are extensions of the flange away from the opening. Preferably, the extensions are at the leading end of the flange. These extensions ride on top of the guide means as the container is moved to its position with its opening over the cavity, forcing the leading part of the flange through a path separated from the receiving surface, greatly reducing the tendency of that movement to skive toner into the workings of the apparatus. These extensions then ride under the guide means when the container is removed forcing the flange through a lower path skiving toner into the cavity or the container and removing toner from the higher path of the flange of the next container to be positioned over the cavity.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
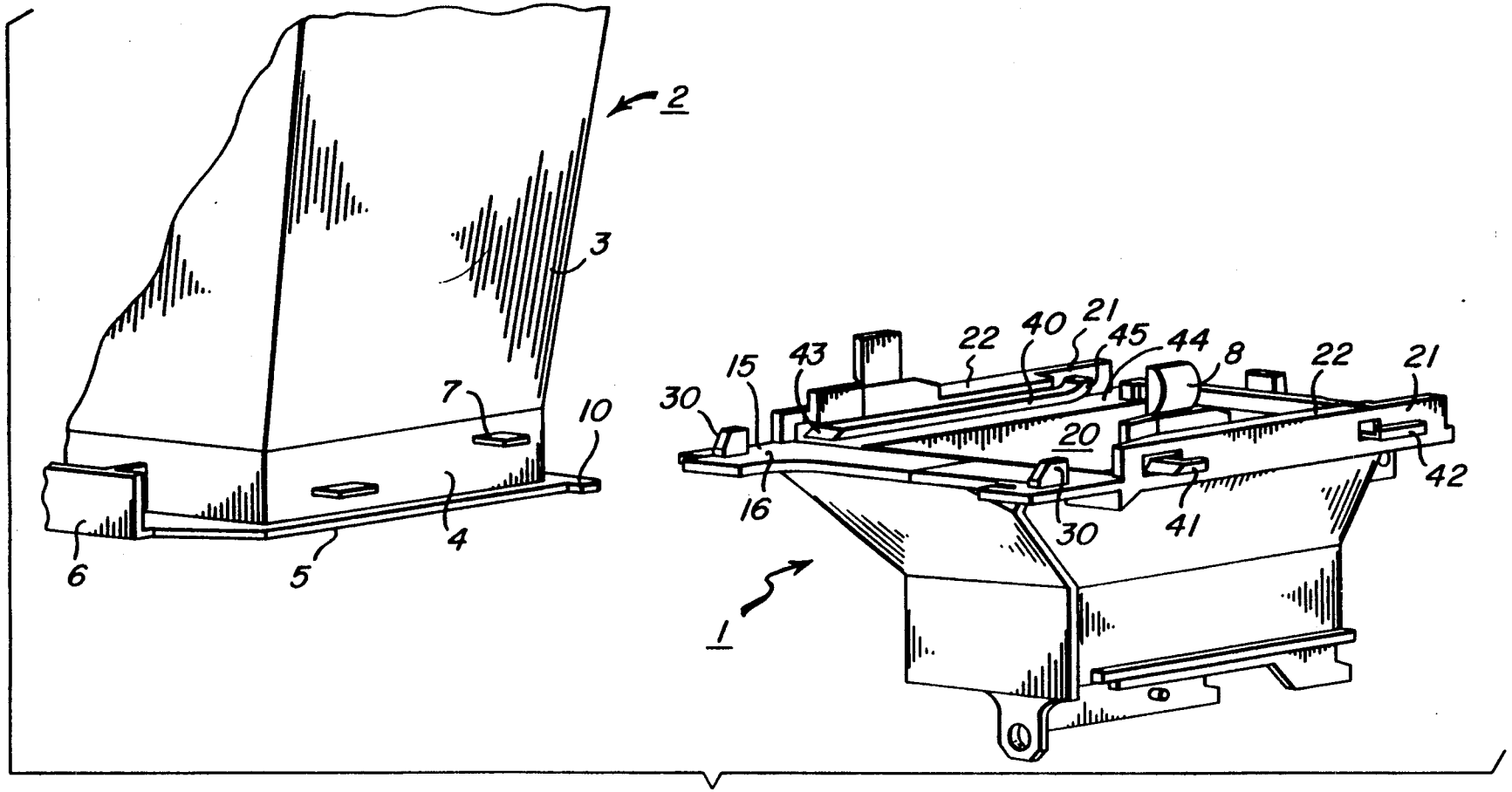
FIG. 1 is a perspective view of a portion of a toner container and a receiving apparatus constructed according to the invention.

Referring to FIG. 1 a toner sump 1 is positioned to receive a toner container 2. In FIG. 1 the toner container 2 is shown without a cover, which cover is shown in FIGS. 2–5 and described below. The toner container 2 has a containing portion 3 for holding a supply of toner. The toner may include carrier particles for use in a two component process or include only toner for either a one or two component process. A bottom, interface portion 4 of the container portion 3 surrounds an opening 9 in the containing portion 3. Interface portion 4 includes an insert flange 5, a handle 6, and a protrusion from a side wall of the interface portion, toner identification tab 7 (described in more detail with respect to FIGS. 6–9). The leading end of insert flange 5 includes lateral extensions 10 which extend away from opening 9 (their function to be explained below). Ordinarily, the interface portions 4 of various size containing portions 3 would be identical.

Toner sump 1 includes a receiving surface 15 (see also FIG. 5) for receiving and guiding the bottom surface of insert flange 5 as the toner container 2 is moved to a position on the sump 1. The sump 1 includes a toner or sump cavity 20 for receiving toner from the container where it is mixed with carrier particles and fed to a development mechanism all by means well-known in the art and not shown herein. Side guides 21 having overhangs 22 help guide flange 5 as it is slid by the operator into position with opening 9 over cavity 20. Receiving surface 15 has an ingress surface portion 16 and a surface portion 44 generally alongside cavity 20. Once in position, overhangs 22 hold flange 5 to surface portion 44.

Referring to FIGS. 2–5, rigid plastic cover 25 is held on flange 5 by angled side rails 26. Protrusions 29 engage the front of flange 5 when the cover is on the container 2. As seen best in FIG. 2, cover 25 includes a first portion 27 which has indents 28 or other suitable detent means and a second portion 11. Indents 28 allow the first portion 27 of the cover to be positioned behind protrusions 30 (FIGS. 1, 2 and 5) on ingress surface 16. The indents 28 cooperate with the protrusions 30 to prevent cover 25 from moving with flange 5 as the container 2 is moved by the operator rearward to a position with opening 9 over the sump cavity 20 as guided in part by receiving surface 15, side guides 21 and the inner surfaces of protrusions 30. Thus, the containing portion 3 of container 2 is slid away from cover 25 when the containing portion is moved over cavity 20.

Figure 4:
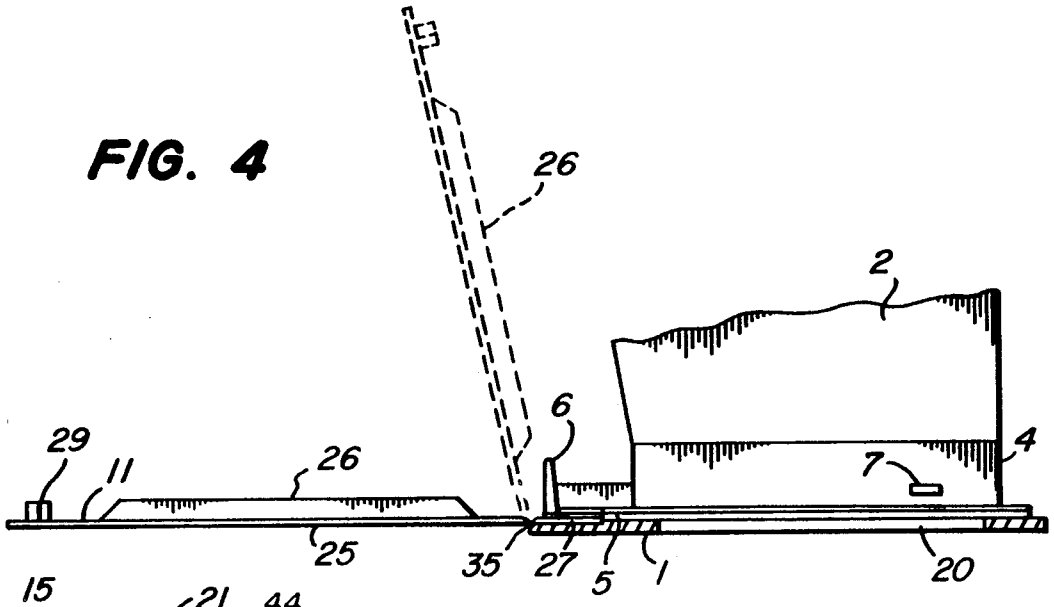
FIG. 4 is a side view of the toner container and cover shown in FIG. 2.

As shown best in FIG. 4, once the toner container 2 is positioned over the sump cavity 20 the cover 25 extends substantially to the left from the interface portion 4 of the container 2. In prior devices, it was common to move the toner container in a direction parallel to the front door of the apparatus into which it was being inserted, which meant that the cover did not interfere with closing of the door. However, the toner supply system shown herein is designed for apparatus with a number of development stations placed side-by-side. With such an arrangement it is not structurally possible to move the toner container according to the prior art, because it will be restricted by the toner container next to it.

Accordingly, the toner container shown in FIG. 1 is designed to be inserted directly from the front of the machine toward the back of the machine leaving the cover 25 in a position in which it can interfere with closing the front door of the apparatus. To solve this problem, the cover 25 itself includes a hinge 35 across the direction of movement of the containing portion 3 about which the second portion 11 may be rotated to a position shown in phantom in FIG. 4, where it is out of the way and not restricting of the rest of the apparatus, i.e., it allows the front door of the apparatus to be closed. The hinge can be a conventional thinning of the plastic cover.

Figure 2:
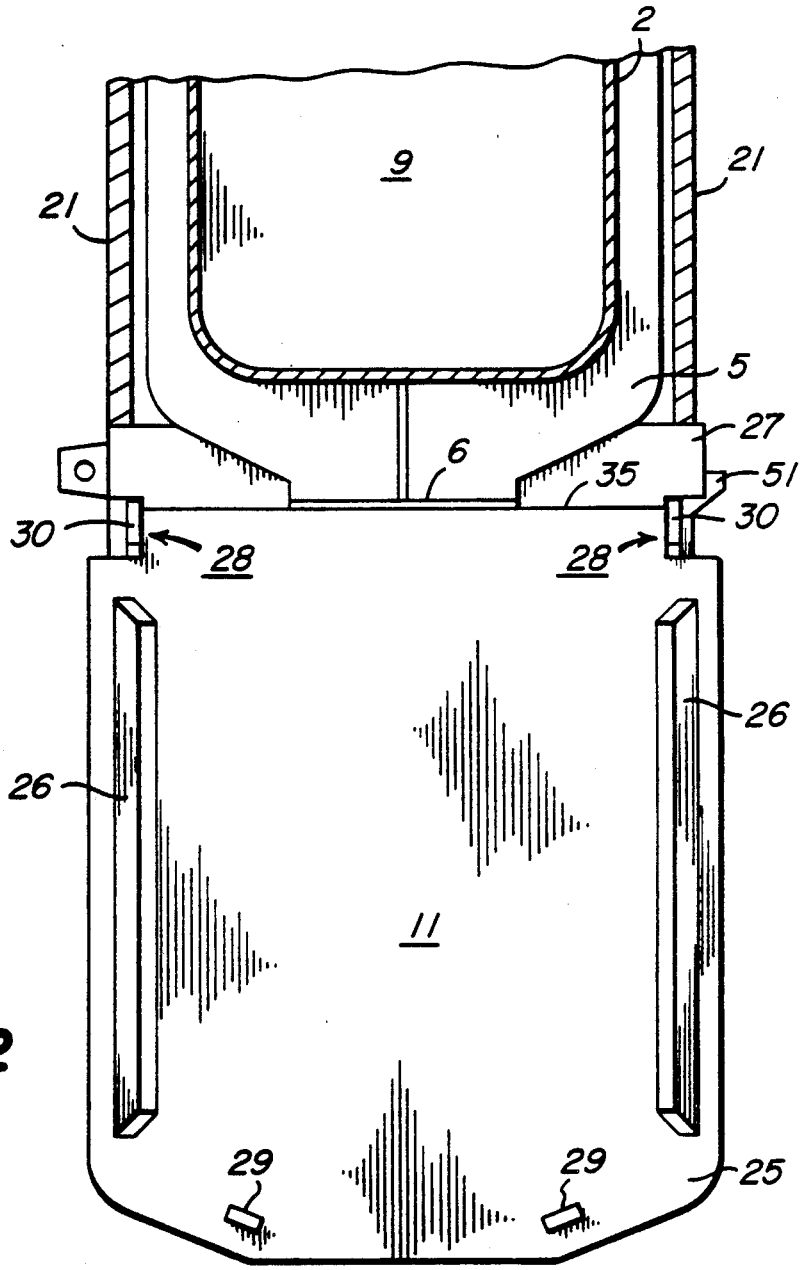
FIG. 2 is a top seciton of a portion of a toner container with its cover in a removed position with a few portions of a toner sump shown.

After the toner bottle is empty, the cover 25 is lowered to its extended position shown best in FIGS. 2 and 4, and the toner container is slid back out onto the cover (a position beside or to the side of the sump cavity) for removal and disposal with a minimum loss of unused toner and a minimum of dirtying the person and clothing of the operator.

Figure 5:
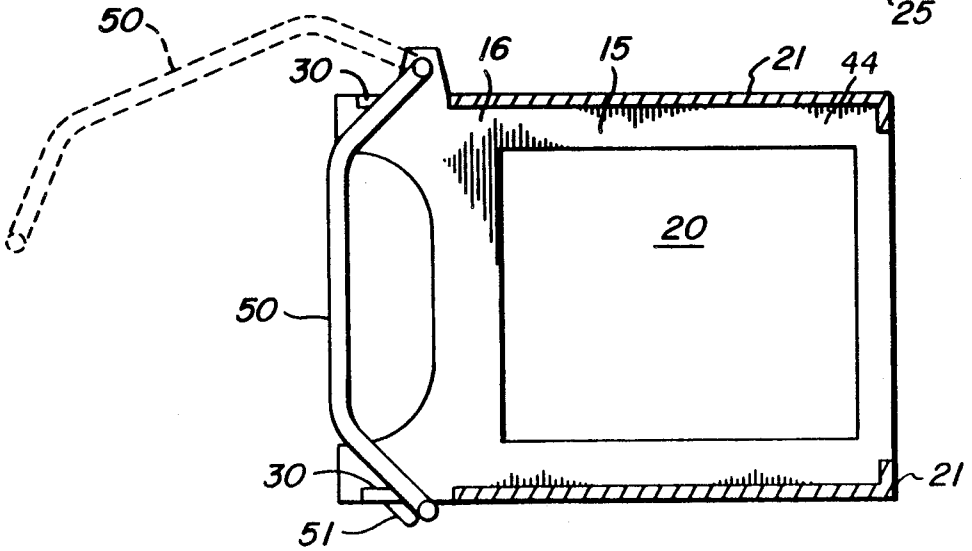
FIG. 5 is a top view of a toner sump, portions of which are shown in FIGS. 2, 3 and 4.

FIG. 5 shows a gate 50 which can be swung open to permit access to the sump for the container 2. After the containing portion 3 has been moved over the sump cavity 20 and the cover 25 has been bent about hinge 35 to its raised position, the gate 50 is closed and lodged behind a detent 51 where it holds the cover in its raised position. The gate 50 also pushes the cover into container 2 assuring that container 2 is completely inserted over sump cavity 20.

Figure 3:
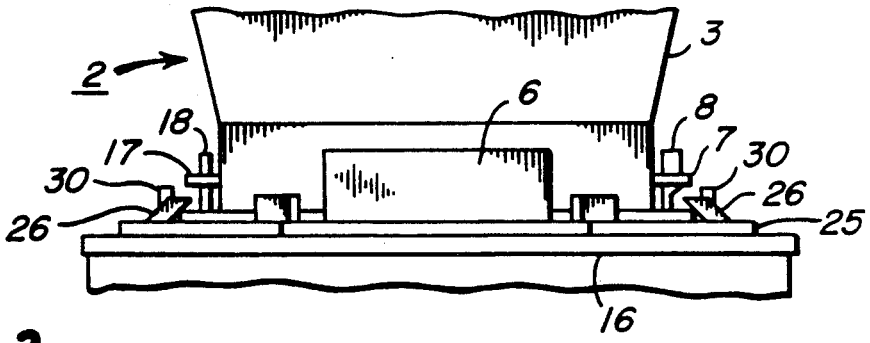
FIG. 3 is a front view of the bottom portion of the toner container and cover shown in FIG. 2 with a few portions of the toner sump shown.

To enable the use of common parts for more than one apparatus the toner container 2 in combination with the sump 1, contains a system for discriminating between two different types of toner. According to FIGS. 6–9, when toner container 3 is manufactured it contains tabs 7 and 17, tab 7 is also shown in FIG. 1. Both tabs 7 and 17 are also shown in FIG. 3 for illustration, although, in fact, both would not be present in any one use. Tabs 7 and 17 are shown as molded protrusions from opposite side walls of interface portion 4, which side walls are generally parallel to the direction of movement of the container as it moves over sump cavity 20. However, they can be any removable protrusions from opposite sides of the lower part of the container. For example, they could be protrusions upward from insert flange 5.

According to the type of toner placed in container 3, one of the tabs is removed in the factory. The toner container shown in FIGS. 6 and 7 contains a first toner and has tab 7 eliminated leaving only tab 17 on the left side of the toner container. The toner container shown in FIGS. 8 and 9 contains a second toner and has tab 17 eliminated leaving only tab 7 on the right side. The toner sump 1 also has removable interfering means, for example, sump tabs 8 or 18, either of which can be eliminated in the field by a service person or in the factory. Both sump tabs 8 and 18 are shown in FIGS. 1 and 3 for illustration, although at least one would be eliminated in actual use. They are made to be removable by hand, i.e., merely by bending off.

Figure 6:
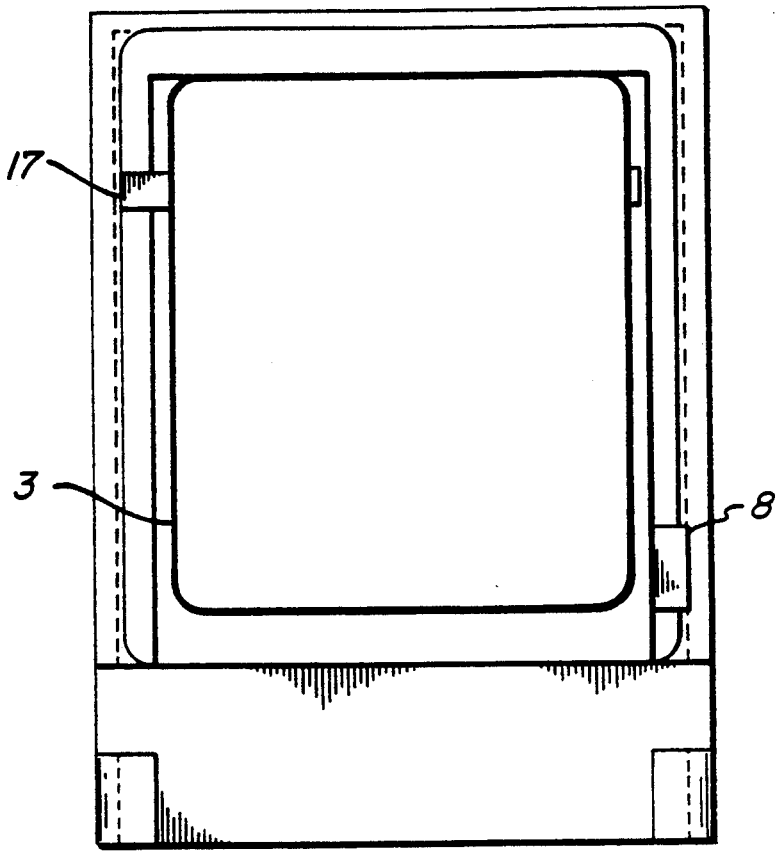
FIGS. 6 and 7 are top and front simplified views of a toner container—receiving apparatus interface illustrating the use of toner identification tabs for a first toner.
Figure 7:
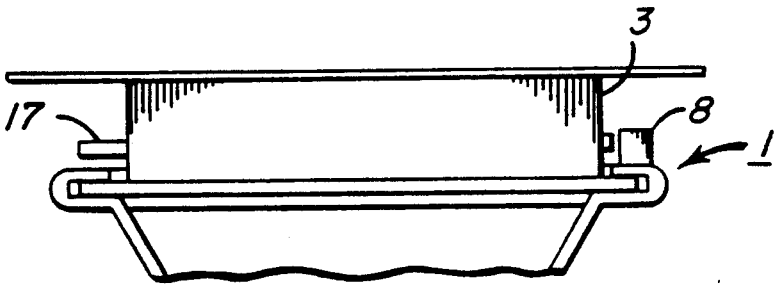
Figure 8:
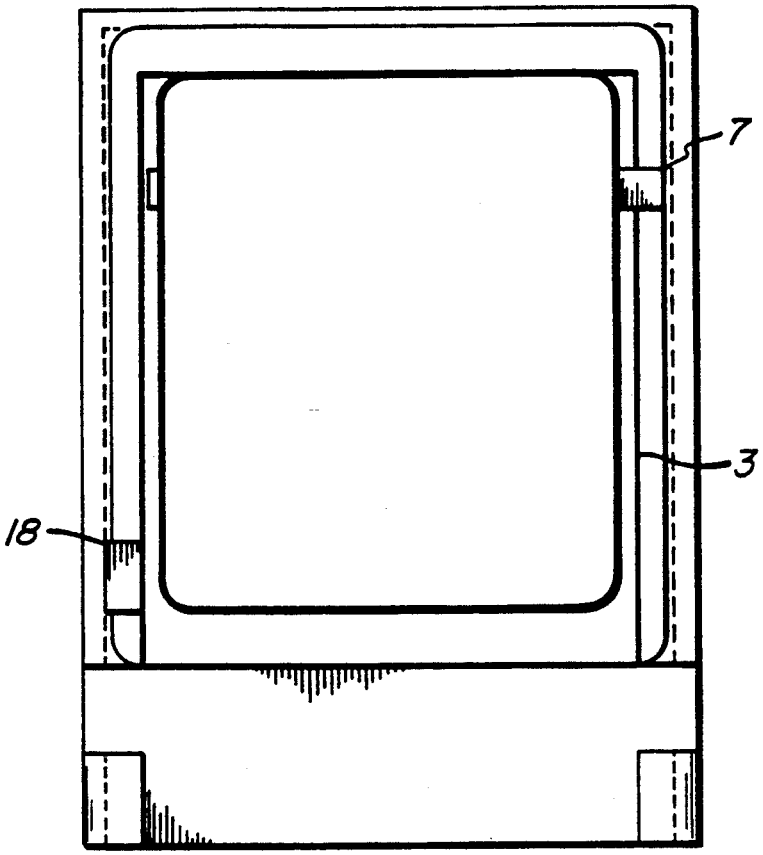
FIGS. 8 and 9 are top and front schematic views similar to FIGS. 6 and 7 illustrating the use of toner identification tabs for a second toner.
Figure 9:
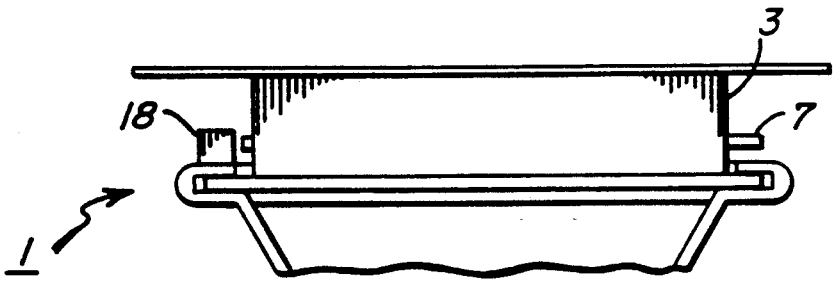

For a sump that is to receive a first toner, the tab 8 is allowed to remain and the tab 18 is eliminated (FIGS. 6 and 7). For a sump that is to receive a second toner, as shown in FIGS. 8 and 9, the tab 18 remains while the tab 8 has been eliminated. If an operator attempts to put a container containing a second toner into a sump adapted for a first toner, sump tab 8 will interfere with container tab 7 and prevent insertion of the toner container to its position above the sump. Similarly, if an operator attempts to put a toner container with a second toner onto a sump adapted for the first toner, tab 18 will interfere with tab 17 to prevent that insertion. The correct toner is permitted, as shown best in FIGS. 7 and 9.

Any of the four tabs can be easily eliminated manually. Therefore, all containers and sumps may be machine manufactured identically using the same molds. The adjustment for the type of toner made is then a manual or machine severing process, i.e., it is cut off. This feature is very useful in the manufacture of designs of closely related models of a copier or printer which use different materials. For example, a color model may be designed to take one type of toner, for example, a toner compatible with a fuser using other color toners, while another model receives a toner adapted for a black only machine which may not be compatible with a fuser for the color toners, but may have other advantages. The system can also be used for a single apparatus that receives two colors of toner in development sumps which are identical except for tabs, for example, a black station and a red or other color station. It can also be used in a single apparatus that takes a magnetic black toner and a non-magnetic black toner in essentially identical sumps.

Prior toner supply system similar to the one disclosed herein lose some toner into the workings of the machine through a skiving process created by structure similar to flange 5. This problem is best seen with respect to FIG. 1. As the toner container 3 is slid into position above the sump cavity 20, the leading edge of flange 5, in the prior art, will sometimes skive a certain amount of toner already in or around the sump into the workings of the machine. It is well recognized that airborne or otherwise loose toner is an enemy of the entire machine as well as the operator.

In the apparatus shown in FIG. 1, this problem is corrected through the combination of a pair of ski shaped, elongated inserts 40 called "skis" herein and the extensions 10 on insert flange 5. Skis 40 are inserts loosely held to side guides 21 by tabs 41 and 42. A first end (leftmost in FIG. 1) of each ski has a cam surface, for example, a ramp 43 which guides extensions 10 and therefore the leading part of insert flange 5 to the top of skis 40. As the container 2 is pushed by the operator to its position over sump cavity 20, extensions 10 ride along the top of skis 40 as skis 40 rest on surface portion 44 on opposite sides of or surrounding sump cavity 20. Skis 40 are ramped upward at the other or second end 45 oppoiste ramp 43. As the operator pushes containing portion 3 into the machine, the extensions 10 move beyond the ramped end 45 and settle down on top of surface 44. When the containing portion 3 is removed from the sump 1, for example, when it is empty, the flange extensions 10 engage the bottom of ramped end 45 which is a cam surface forcing the extensions and hence the flange to slide on surface 44 underneath skis 40 (which are moved upward). The containing portion moves toward the left until it has re-combined with cover 25 and can be removed. Thus, the ski-shaped inserts 40 are a means for guiding the leading portion of flange 5 through a "high" path, a path separated from surface 44, as the containing portion is moved over the cavity 20 and along a low path, for example, a path in contact with surface 44 as the containing portion returns to its position beside the cavity 20. As containing portion 3 moves to the left (as shown in FIG. 1), the inside edge of the now trailing inside vertical wall of interface portion 4 skives toner also toward the left. When it reaches the left most edge defining sump cavity 20 the toner must either go down into the cavity or into the toner container above the cover 25. It is not free to soil the operator's person or damage the operation of the equipment. When the next container is placed on the machine, as described above, the flange extensions 10 force the containing portion through a higher path than the path left by the skiving empty containing portion that had just been removed. Because of the skiving action at a lower position in the removal process, little, if any toner is in a position to be skived by the higher path taken by the leading edge of flange 5 during toner container insertion. Thus, the effect of toner being skived into the workings of the machine is greatly reduced or eliminated. This advantage is the same even if flange 5 does not extend forward of the rest of the containing portion 4, since a vertical front wall of the interface portion would also have the problematic skiving effect.

The receiving surface 15 including surface portion 44 surrounding sump cavity 20 can be covered by a cloth, felt, fiber or other compressible material to assist in a leakproof fit between the container 2 and the sump 1, as is well-known in the art. The skis 40 guide the leading edge of the flange 5 to a position over its final inserted position and then down on the cloth or fiber material on surface 44. The cloth or fiber also prevents looseness as flange 5 is held in place by overhangs 22 despite room being provided between overhangs 22 and surface 44 for the two paths of flange 5.

A paper seal, not shown, can be employed over the bottom of container 2. Such seals are common in the industry. For example, the seal can be adhesively affixed to the bottom of flange 5 to seal the container. The seal would be attached beginning with an edge of the seal at the trailing (during insertion) or handle edge of flange 5 and running across the container opening to the leading edge adjacent flange extensions 10. The seal is folded and doubled back upon itself to an accessible end extending from between flange 5 and cover 25. The end is accessible in the vicinity of handle 6. After the container 2 has been positioned above sump 1 and before the cover has been bent to its upwardly position, the accessible end of the paper seal is pulled to remove it allowing the toner to drop into the sump. The paper seal is then thrown away, the cover bent up and the gate closed.

The invention has been described in detail with particular reference to a preferred embodiment thereof, but it will be understood that variations and modifications can be effected within the spirit and scope of the invention as described hereinabove and as defined in the appended claims.

We claim:

1. Receiving apparatus for a toner container which toner container is of the type having a containing portion with an opening in its bottom and a flange on at least two opposite sides of the opening, said flange having at least one projection which extends laterally from the remainder of said flange in a direction away from the opening, said receiving apparatus comprising:

toner receiving means for receiving toner from a toner container positioned with its opening above said receiving means, a receiving surface on at least opposite sides of said receiving means over which the flange of a received container is movable as it moves along a path from a position to one side of said receiving means to a position over said receiving means and then back to a position on one side of said receiving means, meams for engaging the projection of the flange of a received container for guiding such a flange along a higher path relative to said receiving means as it moves to its position over said receiving means and along a path lower than the higher path as it moves from its position over said receiving means to its position at one side of said receiving means.

2. Receiving apparatus for a toner container, which toner container is of the type having a container portion with an opening in its bottom and a flange on at least two opposite sides of said opening, said flange having at least one projection which extends laterally from the remainder of said flange in a direction away from the opening, said receiving apparatus comprising:

means defining a sump cavity for receiving toner from a containing portion with its opening above said cavity, a receiving surface on at least opposite sides of said cavity over which the flange of a received containing portion is moved as it moves along a path from a position beside said cavity to a position with its opening over said cavity and then back to a position beside said cavity, and an elongated insert positioned along a side of said cavity, one end of said insert having a first cam surface for engaging said projection and forcing said flange to move along the top of said insert to separate from the receiving surface at least the part of the flange which is leading as the container moves to its position with its opening over said cavity, the other end of said insert having a second cam surface forcing said projection to move below said insert as the container moves from a position with its opening over said cavity to a position beside said cavity.

3. Receiving apparatus according to claim 2 wherein said apparatus includes an elongated insert on each of opposite sides of said cavity.

4. Receiving apparatus according to claim 2 wherein said insert is movable between a position in which it rests on said receiving surface when said containing portion is moving into a position over said cavity and wherein it rests on top of a portion of said flange as said containing portion moves from its position over said cavity to its position beside said cavity.

5. Receiving apparatus according to claim 3 wherein each insert is movable between a position in which it rests on said receiving surface when said containing portion is moving into a position with its opening over said cavity and wherein it rests on top of a portion of said flange as said containing portion moves from a position with its opening over said cavity to its position beside said cavity.

6. A container for supplying toner to a receiving apparatus which receiving apparatus is of the type having a toner receiving means with an upwardly facing opening for receiving toner, a receiving surface on at least opposite sides of said receiving means over which a received toner container is movable as the container moves along a path from a position to one side of said receiving means to a position over said receiving means and then back to a position to one side of said receiving means, and means for guiding said container along a highger path relative to said receiving means as the container moves to a position over said receiving means and along a path lower than said higher path as the container moves from the position over said receiving means to a position at one side of said receiving means, said container comprising:

a containing portion having an opening in its bottom, a flange adjoining said opening, a projection from said containing portion, which projection is fixed with respect to said flange and extends laterally beyond said flange away from said opening, said projection comprising means for cooperating with said means for guiding to move the container along a higher path relative to said receiving means as the container moves to a position over said receiving means and along a path lower than said higher path as the container moves from the position over said receiving means to a position at one side of said receiving means.

7. A container according to claim 6 wherein said means for cooperating includes two projections fixed with respect to said flange and extending laterally beyond said flange in opposite directions away from said opening.

8. A container according to claim 7 further including a rigid cover for covering said opening, which cover includes means for engaging said flange to hold said cover to said flange, said engaging means permitting sliding movement of said flange and containing portion with respect to said cover in a direction uncovering said opening, and wherein said projections are lateral extensions of the portion of said flange which leads in such uncovering movement.

9. A container for supplying toner to a receiving apparatus which receiving apparatus is of the type having a toner receiving means with an upwardly facing opening for receiving toner, a receiving surface on at least opposite sides of said receiving means over which a received toner container is movable as the container moves along a path from a position to one side of said receiving means to a position over said receiving means and then back to a position to one side of said receiving means, and an elongated insert located on said receiving surface for guiding said container along a higher path relative to said receiving means as the container moves to a position over said receiving means and along a path lower than said higher path as the container moves from the position over said receiving means to a position at one side of said receiving means, said container comprising:

a containing portion having an opening in its bottom, a flange adjoining said opening, a projection from said containing portion, which projection is fixed with respect to said flange and extends laterally beyond said flange away from said opening, said projection comprising means for cooperating with said elongated insert to move the container along a higher path relative to said receiving means as the container moves to a position over said receiving means and along a path lower than said higher path as the container moves from the position over said receiving means to a position at one side of said receiving means.

* * * * *